US008139091B2

(12) United States Patent
Wu

(10) Patent No.: US 8,139,091 B2
(45) Date of Patent: Mar. 20, 2012

(54) DISPLAY SYSTEM HAVING RESOLUTION CONVERSION

(75) Inventor: Kuan-Yi Wu, Jen Te Hsiang (TW)

(73) Assignee: Chi Lin Technology Co., Ltd, Tainan County (TW)

( * ) Notice: Subject to any disclaimer, the term of this patent is extended or adjusted under 35 U.S.C. 154(b) by 754 days.

(21) Appl. No.: 12/344,238

(22) Filed: Dec. 25, 2008

(65) Prior Publication Data

US 2010/0165014 A1 Jul. 1, 2010

(51) Int. Cl.
*G09G 5/02* (2006.01)

(52) U.S. Cl. ..... 345/698; 345/660; 348/581; 382/298

(58) Field of Classification Search ..... 345/98, 345/204, 660, 667, 670, 671, 690, 694, 698; 382/237, 298–300; 348/445, 561, 581; 358/525, 358/528; 708/208
See application file for complete search history.

(56) References Cited

U.S. PATENT DOCUMENTS

| | | | | |
|---|---|---|---|---|
| 5,140,648 | A * | 8/1992 | Hackett et al. | 382/299 |
| 6,587,602 | B2 | 7/2003 | Wakisawa et al. | |
| 7,199,837 | B2 | 4/2007 | Callway et al. | |
| 7,688,337 | B2 * | 3/2010 | Zhu | 345/660 |
| 2003/0090592 | A1 * | 5/2003 | Callway et al. | 348/581 |

* cited by examiner

*Primary Examiner* — Regina Liang
(74) *Attorney, Agent, or Firm* — Ming Chow; Sinorica, LLC

(57) ABSTRACT

There is disclosed a display system comprising an input buffer to receive a set of pixel data in line direction from a source image; a scaling factor generation module to generate a scaling value set according to an original resolution Vi of the source image and a resolution Vo of a display panel; a horizontal scaling execution module to receive the scaling value set so as to determine pixel replication for each pixel from the set of pixel data; a memory control module to receive replicated pixels by the pixel replication and subsequently to store the replicated pixels of each line for at least a complete image file; a vertical scaling execution module to receive the scaling value set to determine line replication of each line; and an output buffer to receive each of the replicated lines so as to form all of the replicated lines at the display panel.

20 Claims, 15 Drawing Sheets

DISPLAY SYSTEM HAVING RESOLUTION CONVERSION

BACKGROUND OF THE INVENTION

1. Field of the Invention

The invention relates to an image display technique, and more particularly to an image display having resolution conversion.

2. Description of the Related Art

This application claims the benefit of U.S. application Ser. No. 12/340,792 entitled "Image Resolution Adjustment Method" filed on Dec. 22, 2008. The disclosure of the Application is incorporated herein.

For current display devices, electronic monitor systems are widely applied in various applications, such as digital cameras, liquid crystal display (LCD) devices, and LCD televisions. In order to conform to specifications of electronic monitor systems with different resolutions, the resolutions of image sources have to be controlled by scaling images. For example, when a resolution of an input image is in VGA mode (640×480) while an output device is in XGA mode (1024×768), the resolution of the input image has to be enhanced, and when a resolution of an input image is in SXGA mode (1280×1024) while an output device is in XGA mode (1024×768), the resolution of the input image is degraded.

Conventional image scaling control techniques usually use resolution (i.e. pixel or line of an image) interpolation or replication during an image upscaling period. An image which is upscaled by interpolation advantageously has smooth edges from the perspective of human vision; however, the content of the original image is changed so as to result in image degration for its accuracy. When an image is upscaled by replication, disadvantageously, the image has sawtooth edges if the scaling ratio for the image is not controlled appropriately, resulting in degraded quality of the image.

Please referred to FIG. 1, U.S. Pat. No. 6,587,602 discloses a resolution conversion system. The system mainly includes a horizontal scaling calculation section 101 and vertical scaling calculation section 102, wherein the horizontal scaling calculation section 101 receives original image data 103 of 8 pixels constituting one single horizontal line and another original image data 104 of 8 pixels constituting a subsequent single horizontal line, and converts the number of pixels in a horizontal direction. In addition, the horizontal scaling calculation section 101 is supplied with a control signal 108 representative of a horizontal magnification factor for indicating how many pixels are to be added to the pixels of the original image in the horizontal direction. The vertical scaling calculation section 102 receives image data 105 of 8.±.n pixels constituting the line output by the horizontal scaling calculation section 101 and another image data 106 of 8.+−.n pixels constituting the next line output by the horizontal scaling calculation section 101. In addition, the vertical scaling calculation section 102 is supplied with a control signal 109 representative of a vertical magnification factor for indicating how many pixels are to be added to the pixels of the original image in the vertical direction. The vertical scaling calculation section 102 executes the above mentioned process successively for the original image data of the pixel block unit of 8.times.8 pixels, whereby the image data 107 of a line to be interpolated are generated so as to convert the number of pixels in the vertical direction. However, the prior art uses interpolation to provide the resolution conversion so as to cause original pixel data change from the source image unfortunately, and it is not appropriate in some cases of the emergent medical surgery because this situation does not allow any change of original pixel data to prevent any of the medical mistakes from viewing the original medical images.

Besides, U.S. Pat. No. 7,199,837 also discloses a system for improving a ratiometric expansion. The prior art provides, after an image being enlarged by a replicator, the resolution of the image re-adjusted by a re-sampler. However, the prior art is trouble with disadvantageously complicating image scaling calculation and smoothness.

BRIEF SUMMARY OF THE INVENTION

In order to solve the above mentioned problems, the present invention provides a display system which comprises an input buffer, a scaling factor generation module, a horizontal scaling execution module, a memory control module, a vertical scaling execution module and an output buffer. The input buffer receives a set of pixel data in a line direction from a source image, in a first-in-first-out and pixel-by-pixel fashion. The scaling factor generation module generates a scaling value set according to an original resolution Vi of the source image and a display resolution Vo of a display panel, respectively. The horizontal scaling execution module receives the scaling value set from the scaling factor generation module so as to determine pixel replication of each pixel in the line direction from the input buffer for outputting. The memory control module receives replicated pixels configured by the pixel replication through the horizontal scaling execution module, and configures to store each scaled line of the replicated pixels in line by line. The vertical scaling execution module receives the scaling value set from the scaling factor generation module so as to determine line replication of each scales line in the memory control module for outputting; and the output buffer receives replicated lines configured by the line replication through the vertical scaling execution module and outputs each of the replicated lines to the display panel in a first-in-first-out and pixel-by-pixel fashion.

Therefore, it is a principal object of the present invention to provide a display system having resolution conversion in medical or other related applications to acquire a scaled image with higher resolution without content loss of the source image during image scaling process.

It is another principal object of the present invention to provide a display system for implementing horizontal scaling execution during a horizontal period and then vertical scaling execution during a vertical period for greatly reducing the calculation complexity of scaling, and greatly saving memory space in units of replicated pixels rather than lines.

It is yet another principal object of the present invention to provide a display system having different scaling modes in a scaling phase and a smoothing phase for converting a source image into a scaled image to meet the display resolution, so as to ensure the scaled image having replicated pixels and replicated lines arranged in positional symmetry along horizontal and vertical directions of the source image.

It is yet another principal object of the present invention to provide a display system so as to properly smooth a scaled image in a smoothing phase based on a variety of application requirements of display.

It is yet another principal object of the present invention to provide a display system having different scaling modes for converting a source image into a scaled image based on the scaling factors for pixel and line replications such that the scaling factors of the source image are arranged in a gradually decreased proportion from its central region to peripheral regions of the source image.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims. Moreover, the diagrams included in the following are not completely drawn according to the real size and are only used to demonstrate features related to the present invention.

Figure 1:
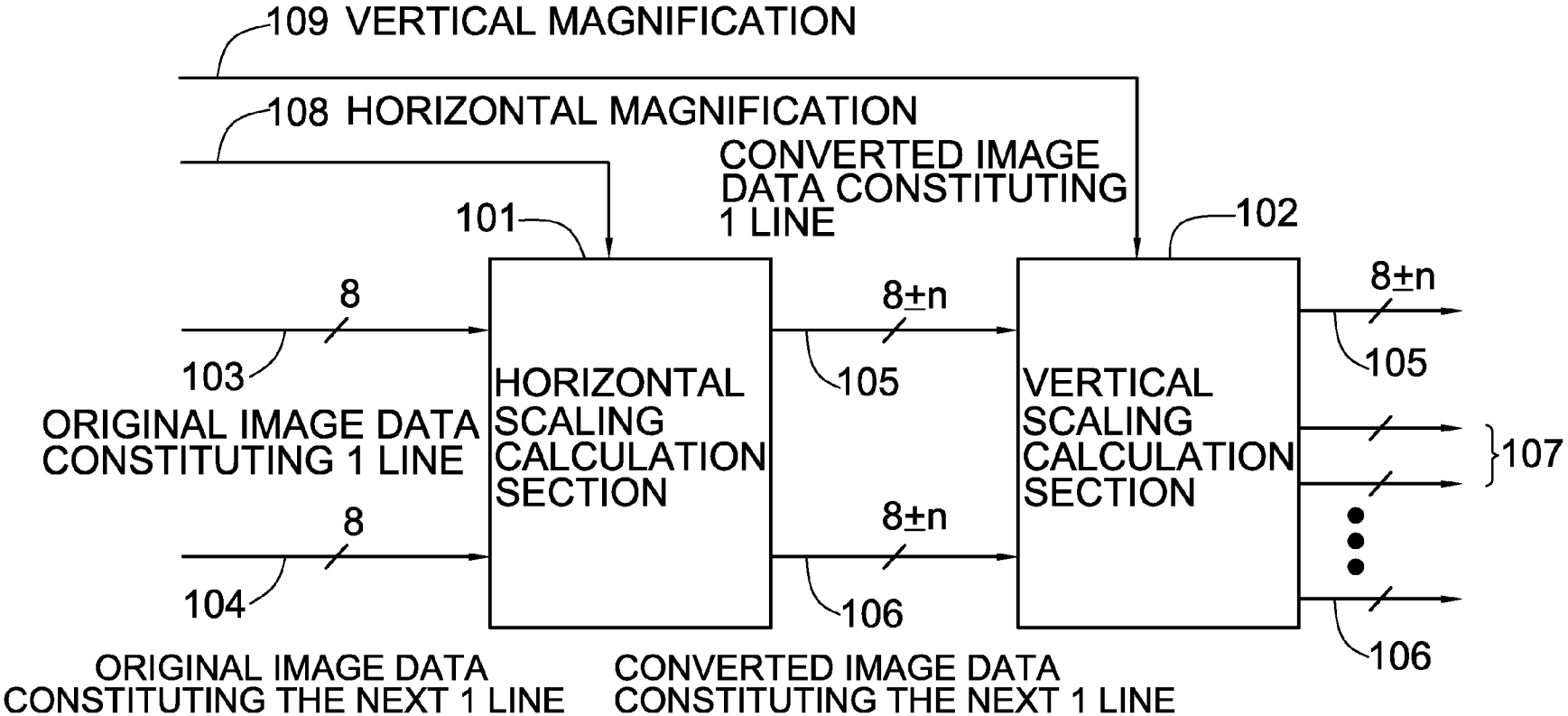
Fig. 1(prior art)
FIG. 1 is a block diagram schematically illustrating a conventional resolution conversion system.
Figure 2:
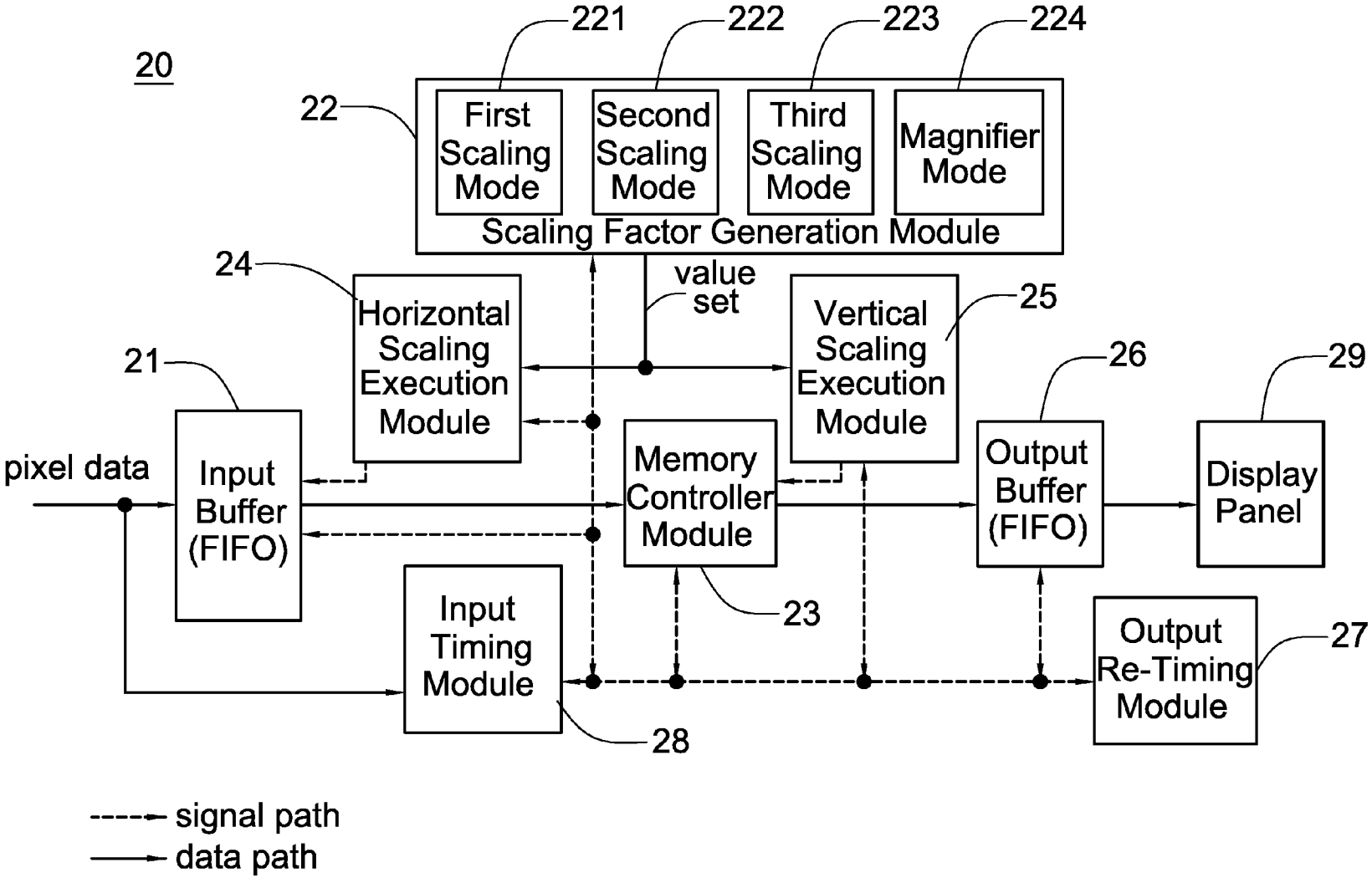
FIG. 2 is a is a block diagram schematically illustrating a display system having resolution conversion according to an embodiment of the invention.

Referred to FIG. 2, a display system with resolution conversion is provided herein. In an exemplary embodiment of a display system, a display system 20 comprises an input buffer 21, a scaling factor generation module 22, a horizontal scaling execution module 24, a memory control module 23, a vertical scaling execution module 25 and an output buffer 26. The input buffer 21 is provided to receive a set of pixel data constituting one line of a source image in a line direction, and the pixel data of each line are received in a first-in-first-out (so called FIFO) and pixel-by-pixel fashion. The scaling factor generation module 22 is provided to generate a scaling value set indicating the number of pixel replication (or line replication) for each image block of the source image and scaling factors corresponding to each image block in horizontal and vertical directions, and the scaling value set is determined by an source resolution Vi of the source image and a display resolution Vo of a display panel 29, which are inputted to the scaling factor generation module 22. It is noted that the scaling factor generation module 22 is performed in scaling phase and smoothing phase, or in the scaling phase only. The horizontal scaling execution module 24 is provided to receive the scaling value set, which is actually calculated by one of four scaling modes including a first scaling mode 221, a second scaling mode 222, a first scaling mode 223 and a magnifier mode 224 in the scaling factor generation module 22, so as to determine pixel replication for each pixel in the input buffer 21 and thus output replicated pixel(s) for each pixel in each line of the source image to the memory controller module 23 so as to form one scaled line having the replicated pixels for storing according to addressing management of the memory control module 23 and the memory control module 23 can store at least a complete image file formed of a number of the scaled lines. The vertical scaling execution module 25 is provided to receive the scaling value set from the scaling factor generation module 22 so as to determine line replication for each scaled line in the memory control module 23 for outputting the replicated lines of a source image to the output buffer 26 in the same data transmission fashion as the input buffer 21. The display panel 29 is provided to display all the replicated lines of a source image in its display resolution.

Figure 3A:
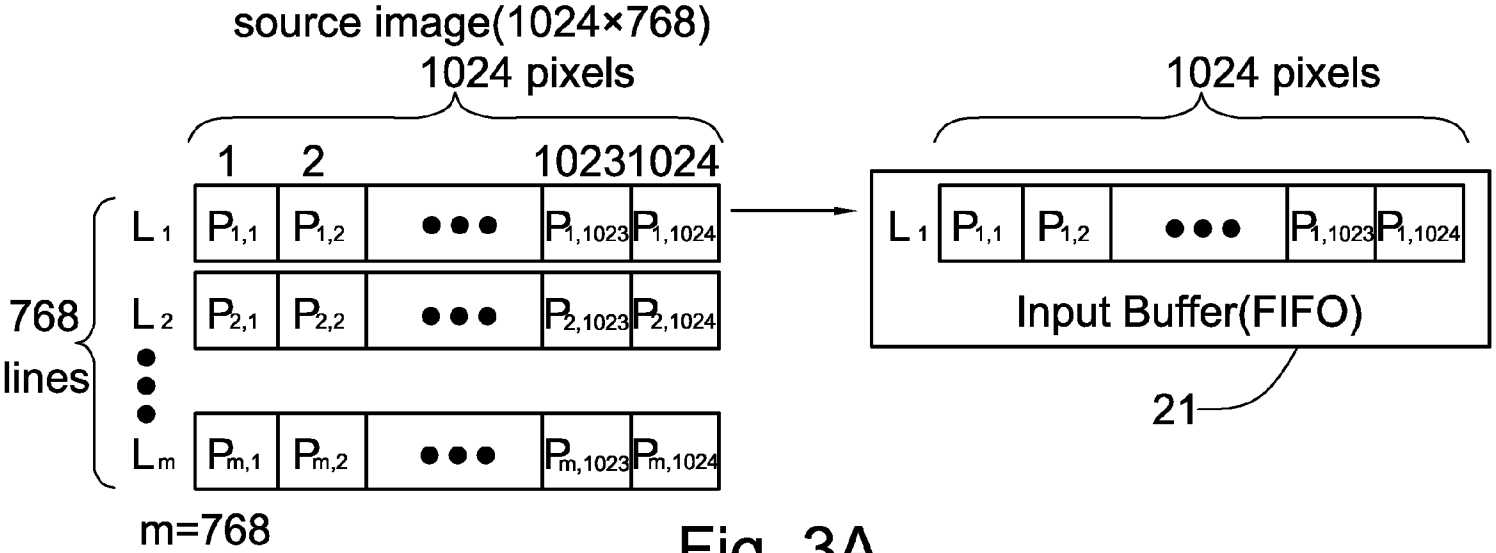
FIG. 3A is a diagrammatic sketch showing each line of pixel data of the source image with resolution 1024×768 transmitted into the input buffer having a variable storage length in the embodiment.
Figure 3B:
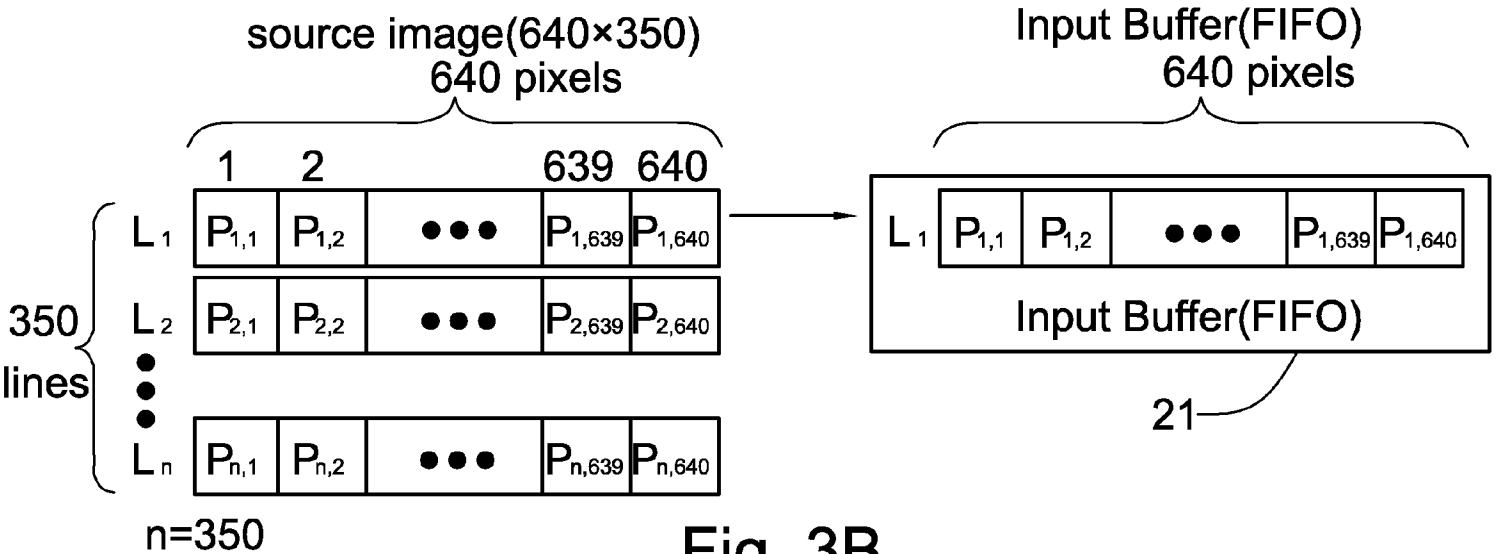
FIG. 3B is a diagrammatic sketch showing each line of pixel data of the source image with resolution 640×350 transmitted into the input buffer having a variable storage length in the embodiment.

Referred to FIGS. 3A and 3B, in the above mentioned embodiment, the input buffer 21 has a variable storage length for receiving a set of pixel data. For example, when a source image of resolution 1024×768 is ready to be converted into a different display resolution, the input buffer 21 will prepare a queue $L_1$ with a storage length of 1024 pixels to receive the source image in a FIFO and pixel-by-pixel fashion. On the other hand, when another source image of resolution 640×350 is ready to be converted, the input buffer 21 will prepare a queue with storage length of 640 pixels to receive the source image in a FIFO and pixel-by-pixel fashion accordingly. Therefore, the input buffer 21 has a queue $L_1$ with a variable storage length to meet each source image conformed to the VESA standard in proper timing. Besides, the input buffer 21 may read and write two sets of pixel data in a quasi-concurrent fashion. For example, the input buffer 21 may prepare two queues, where a first queue is provided to read in a first set of pixel data and a second queue is provided for waiting for a read cycle, and subsequently the first queue writes out the first set of pixel data for output while the second queue reads in a second set of pixel data for input in a write cycle, so as to improve transmission rate of pixel data efficiently.

Figure 4:
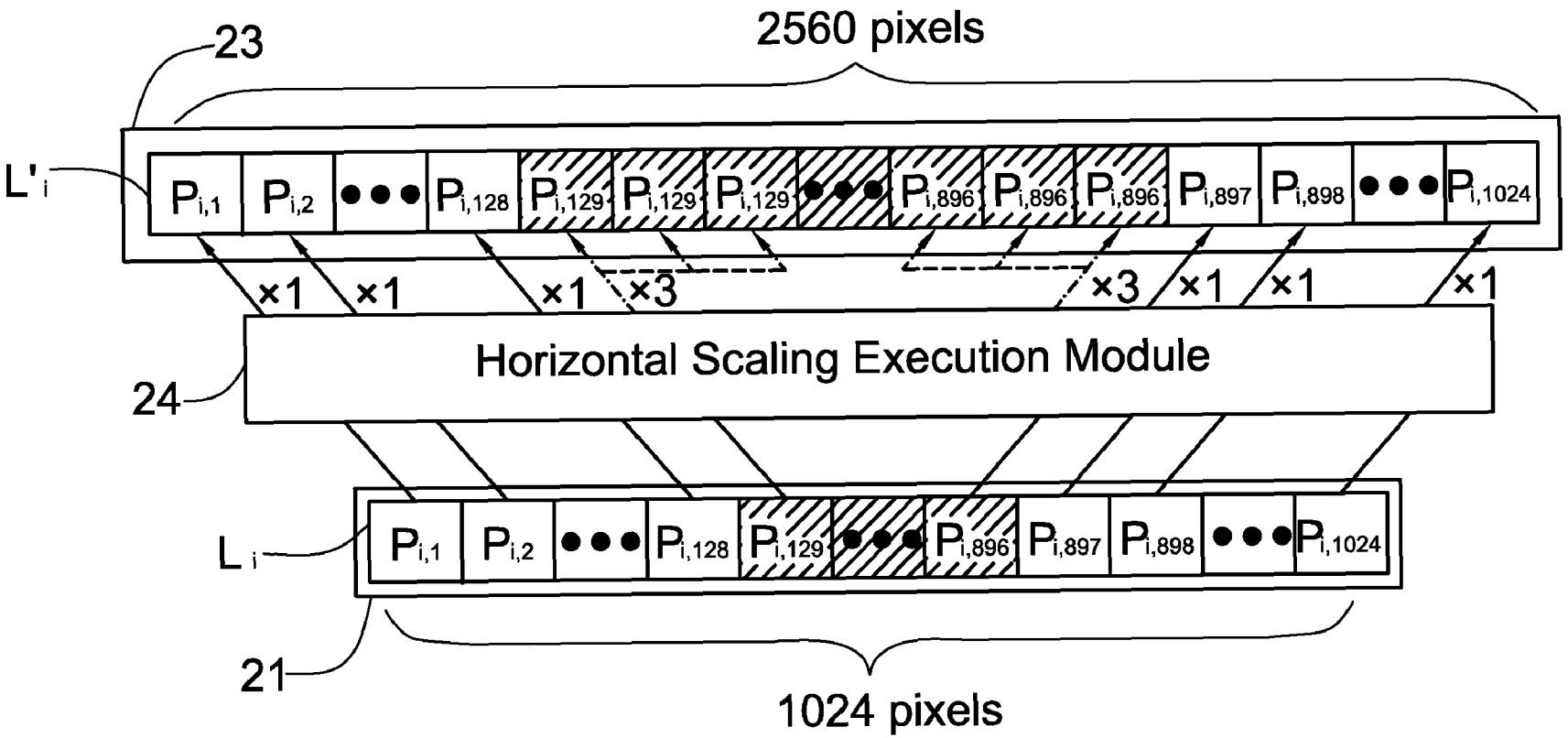
FIG. 4 is a diagrammatic sketch showing pixel replication by the horizontal scaling execution module from the input buffer to the memory controller module in the embodiment.

Referred to FIG. 4, a horizontal scaling operation in the above mentioned embodiment is described as follows. A source image of resolution 1024(pixels)×768(lines) converted into a display panel of resolution 2560(pixels)×2048 (lines) is given according to the first scaling mode. For example, all the pixels in the $i^{th}$ line $L_i$ of the source image with resolution 1024×768 are received in the input buffer 21, and the horizontal scaling execution module 24 during the horizontal scaling period will make pixel replication for each pixel from $P_{i,1}$ to $P_{i,1024}$ based on a value set including Vc, Vs and two corresponding scaling factors to Vc and Vs, where Vc equals to 768 indicated as the number of central pixels from $P_{i,129}, \ldots, P_{i,896}$ in the $i^{th}$ line, Vs equals to 128 indicated as the number of left-sided pixels from $P_{i,1}$ to $P_{i,128}$ and right-sided pixels from $P_{i,897}$ to $P_{i,1024}$ in the $i^{th}$ line, one scale factor for Vc equal to 3 and another scale factor for Vs equal to 1, all the values generated by the first scaling mode 221 and the details will be described in FIGS. 6A and 6B later on. Therefore, the horizontal scaling execution module 24 replicates each of the left-sided pixels $P_{i,1}$~$P_{i,128}$ from the input buffer 21 into the memory control module 23 for one time due to the scale factor for Vs equal to 1, replicate each of the central pixels $P_{i,129}$~$P_{i,896}$ into the memory control module 23 for three times due to the scale factor for Vc equal to 3, and replicate each of the right-sided pixels $P_{i,897}$~$P_{i,1024}$ into the memory control module 23 for one time due to the scale factor for Vs equal to 1. It is obvious that each of the pixels $P_{i,129}$~$P_{i,896}$ has three occurrences in the $i^{th}$ line individually and are marked by slash in FIG. 4. Therefore, a new scaled line $L'_i$ corresponding to the original $i^{th}$ line $L_i$ is newly constructed of 2560 pixels in the memory control module 23. All the pixels in each of the other lines from the source image are up-scaled horizontally by the horizontal scaling execution module 24 in the similar way.

Figure 5A:
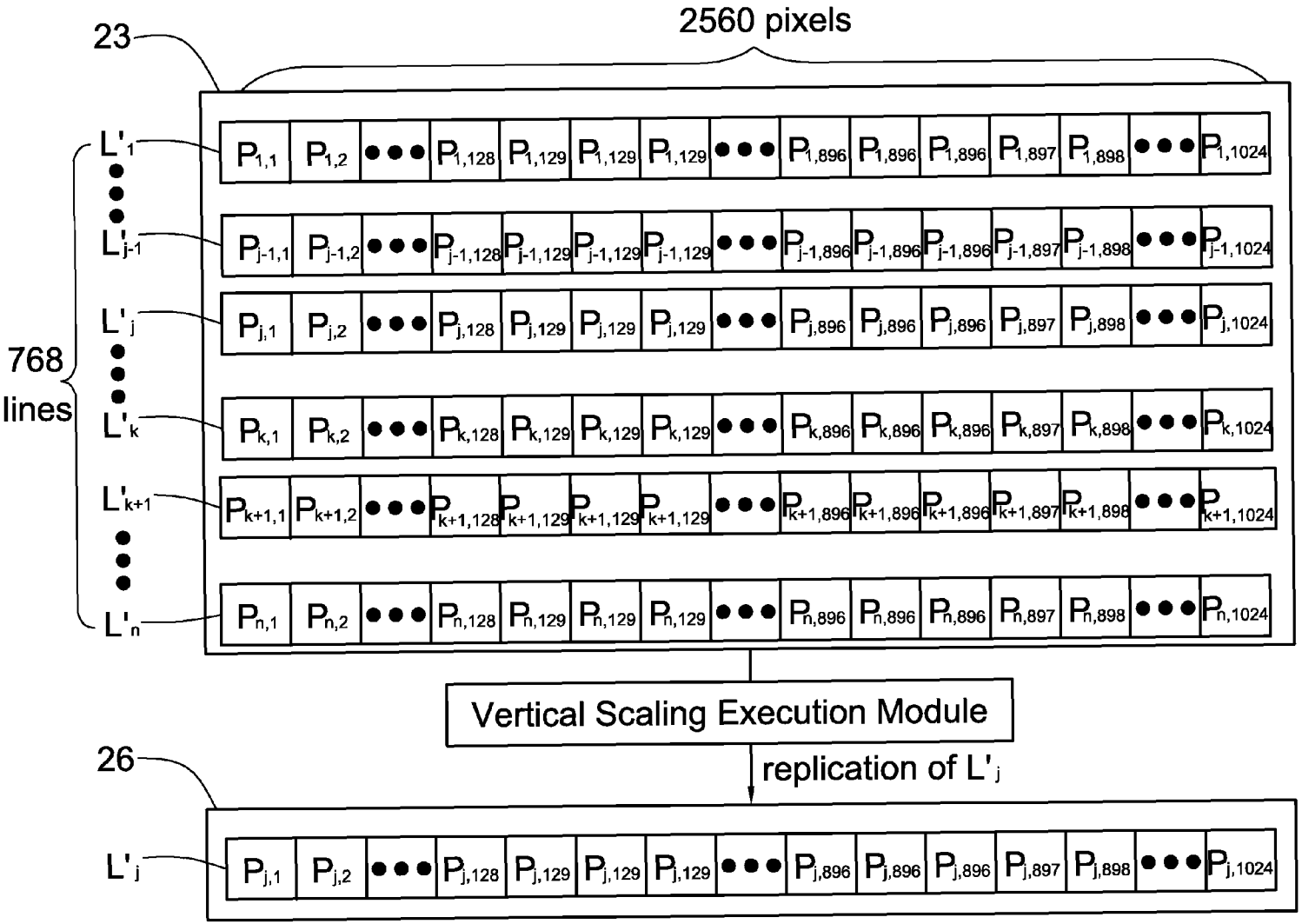
FIG. 5A is a diagrammatic sketch showing the line replication by the vertical scaling execution module from the memory controller module to the output buffer in the embodiment.
Figure 5B:
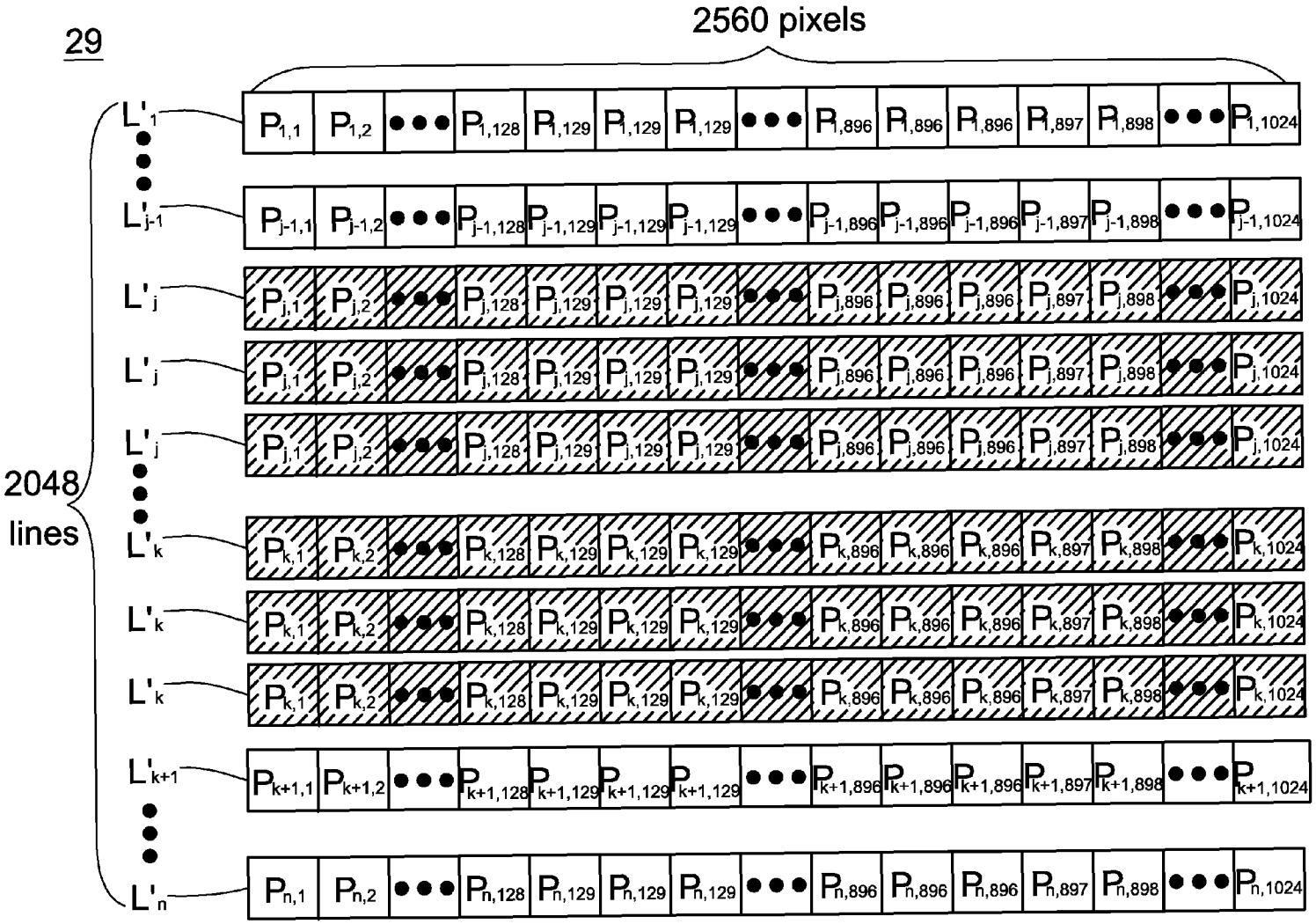
FIG. 5B is a diagrammatic sketch showing the whole scaled image having the replicated lines on the display panel in the embodiment.

Referred to FIGS. 5A and 5B, a vertical scaling operation in the above mentioned embodiment is described as follows. After the horizontal scaling operation is done, the vertical scaling operation starts to proceed next. For example, $L'_i$ (i.e. the $i^{th}$ scaled line) of 2560 pixels is one of the scaled lines $L'_1$~$L'_{768}$ stored in the memory control module 23, and the vertical scaling execution module 25 will make line replication for each of the scaled lines $L'_1$~$L'_{768}$ based on the value set, representative of Vc (the number of central scaled lines $L'_j$~$L'_k$) equal to 640 where j=65, k=704; Vs (the number of upper-sided scaled lines $L'_1$~$L'_{j-1}$, or lower-sided scaled lines $L'_{k+1}$~$L'_n$) equal to 64 where n=768; a scale factor for Vc equal to 3, and a scale factor for Vs equal to 1, generated by the first scaling mode 221. Therefore, the vertical scaling execution module 25 replicates each of the upper-sided scaled lines $L'_1$~$L'_{j-1}$ from the memory control module 23 through the output buffer 26 into the display panel 29 for one time, replicates each of the central scaled lines $L'_j$~$L'_k$ from the memory control module 23 through the output buffer 26 into the display panel 29 for three times, and replicates each of lower-sided scaled lines $L'_{k+1}$~$L'_n$ from the memory control module 23 through the output buffer 26 into the display panel 29 for one time. It is obvious that each of the scaled lines $L'_j$~$L'_k$ has three occurrences in the display panel 29 and is marked by slash. Therefore, all the new lines $L'_1$~$L'_{2048}$ corresponding to the original lines $L_1$~$L_{768}$ in the memory control module 23 are constructed to be a scaled image of 2560 pixels×2048 lines in the display panel 29.

According to the above mentioned embodiment, the image resolutions and display resolutions including (1024×768) vs (2560×2048), (640×350) vs (1024×768), (640×350) vs (1600×1200), and (640×400) vs (2048×1536) are conformed to the VESA standard and are described as follows. According to the above mentioned horizontal and vertical scaling from the display system, any source image having lower resolution can be converted or upscaled to a display image having higher resolution conversion without content lost for the source image during the image scaling process. Besides, the memory controller module 23 is only provided for storing replicated pixels for each line from a source image rather than storing replicated lines so as to not only greatly reduce the scaling complexity but also greatly save the memory space in terms of replicated pixel data rather than line data.

Figure 6A:
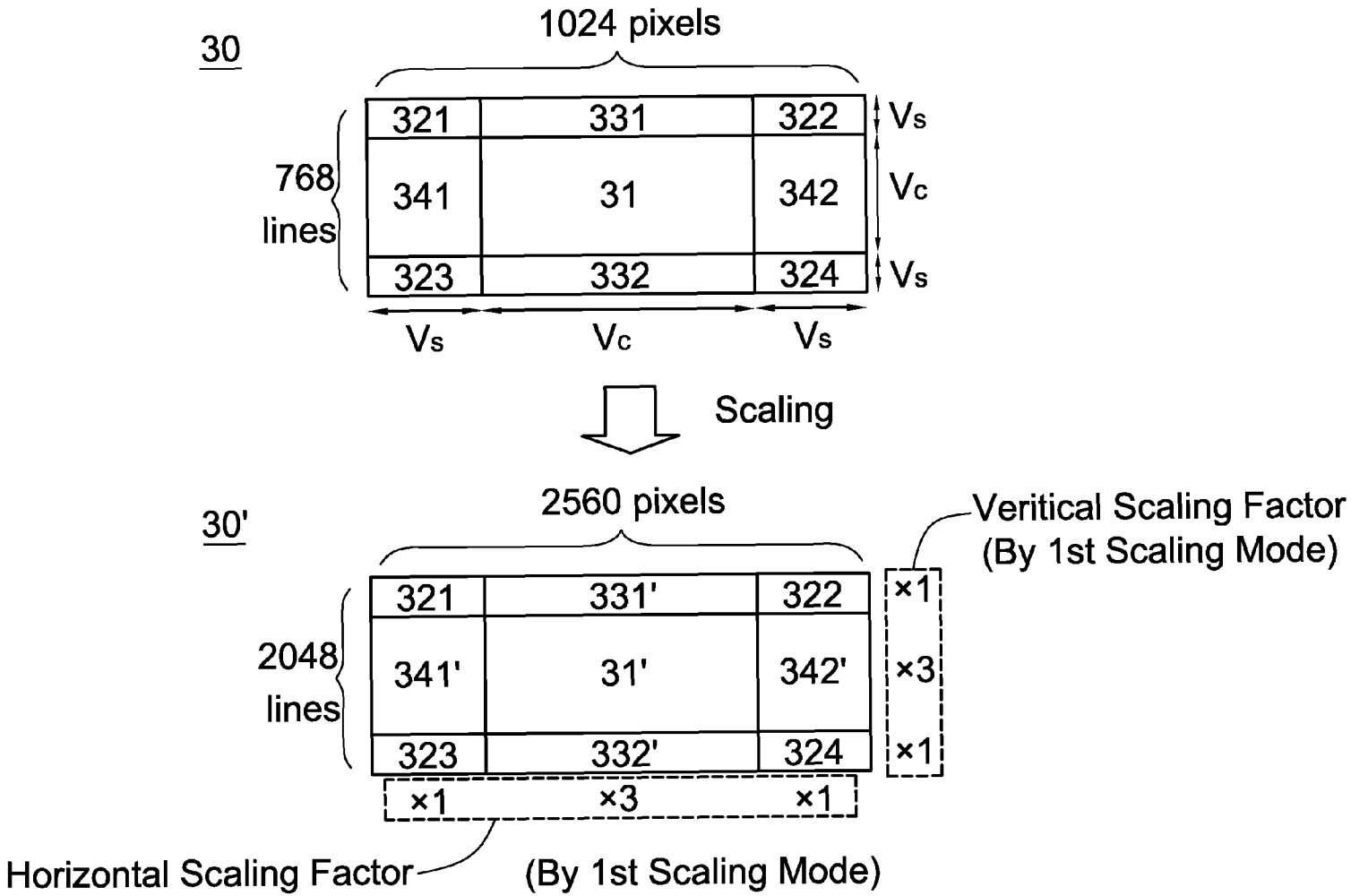
FIG. 6A is diagrammatic sketch showing a first scaling mode operation from a source image with resolution 1024×768 converted to a scaled image with display resolution 2560×2048 in the embodiment.
Figure 6B:
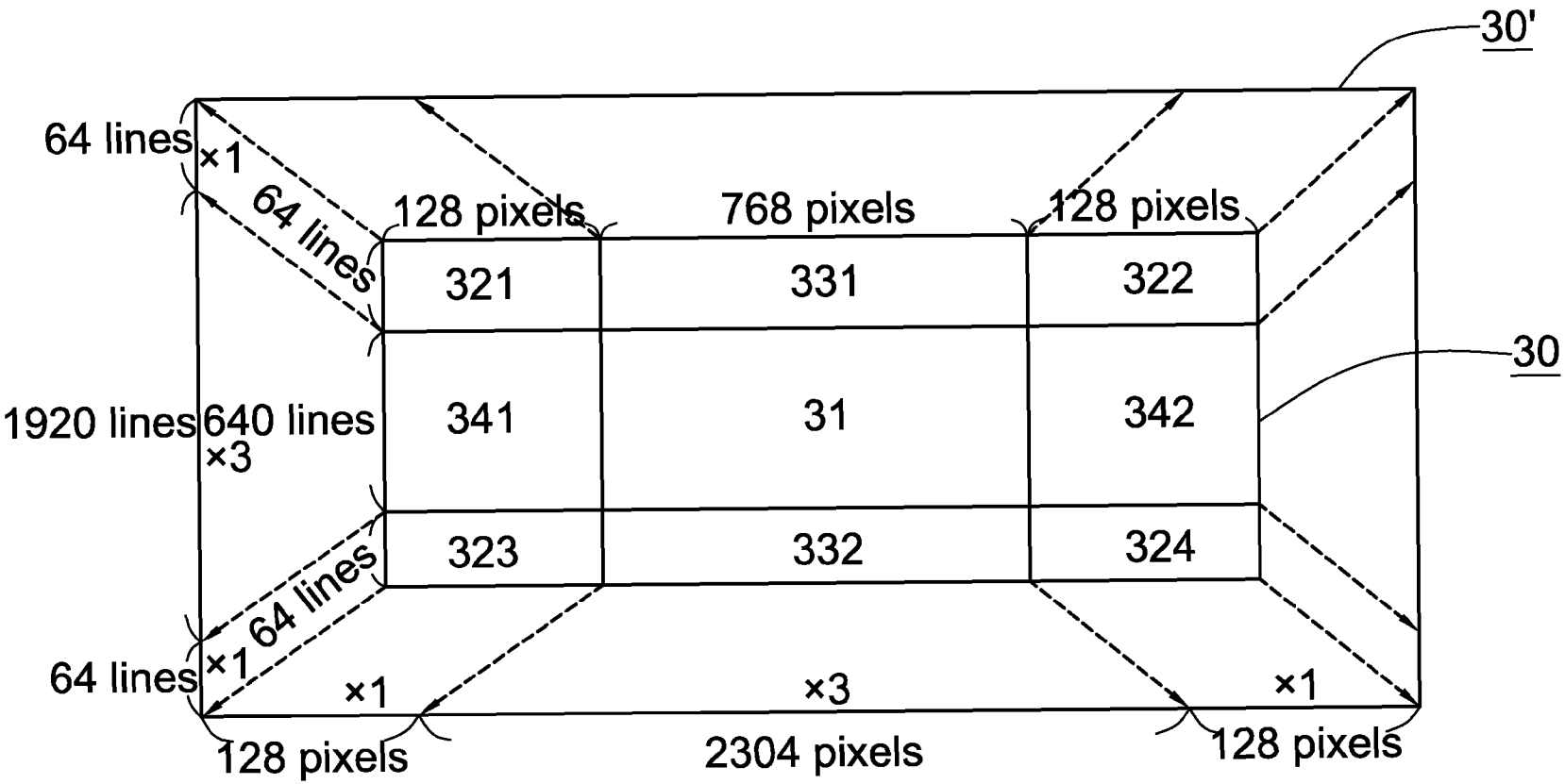
FIG. 6B is a diagrammatic sketch showing a mapping relation from source resolution 1024×768 onto display resolution 2560×2048 in the embodiment.

Referred to FIGS. 6A and 6B, the first scaling mode operation provided for a source image 30 of resolution Vi (1024×768) converted into a display image 30' of resolution Vo (2560×2048) and the mapping relation between source image 30 and display image 30' are described herein. When the scaling factor generation module 22 in the scaling phase receives resolution Vi of the source image 30 and resolution Vo of the display image 30' defined by the display panel 29, the first scaling mode 221 is triggered according to a predetermined selection rule so as to calculate a value set including a center resolution Vc and a sided resolution Vs during a horizontal and a vertical scaling periods, and Vc and Vs are determined by equations (1) and (2) as follows:

$$(Vo-Vi)/2=Vc \quad (1); \text{ and}$$

$$(3Vi-Vo)/4=Vs, \text{ if } Vs=\text{integer} \quad (2),$$

Hence, in this case, the source image 30 is logically divided into a plurality of source blocks 31, 321, 322, 323, 324, 331, 332, 341 and 342. During the horizontal scaling period, each of the source blocks 31, 331 and 332 has a divided resolution value Vc=768 pixels determined by the equation (1), and each of the source blocks 321, 322, 323, 324, 341 and 342 has a divided resolution value Vs=128 pixels determined by the equation (2). During the vertical scaling period, each of the source blocks 31, 341 and 342 has a divided resolution value Vc=640 lines determined by the equation (1), and each of the source blocks 321, 322, 323, 324, 331 and 332 has a divided resolution value Vs=64 lines determined by the equation (2), Vc and Vs labeled in FIG. 6A and its corresponding values labeled in FIG. 6B.

Referred back to FIGS. 6A and 6B, for example, the source center block 31 of a divided resolution (768 pixels×640 lines) has a pair of scaling factors: x3 and x3 in horizontal and vertical directions respectively so that the source center block 31 (768 pixels×640 lines) can be upscaled to the corresponding display center block 31' (2304 pixels×1920 lines) by a horizontal scaling factor x3 and a vertical scaling factor x3 where the display center block 31' is indicated as 31'(x3, x3). Similarly, the other source blocks 321, 322, 323, 324, 331, 332, 341 and 342 of the source image 30 are upscaled to the display blocks 321(x1, x1), 322 (x1, x1), 323(x1, x1), 324(x1, x1), 331'(x3, x1), 332'(x3, x1), 341'(x1, x3), and 342' (x1, x3) shown in FIG. 6A, wherein each of the display blocks 331', 332', 341' and 342' numbering ended with ' in the display image 30' means that there is at least a scaling factor greater than one in either horizontal or vertical scaling while each of the blocks 321, 322, 323 and 324 numbering ended without ' in the display image 30' is remained as its same original source image.

Besides, referred back to FIG. 6B, resolutions of the source blocks 321, 322, 323, 324, 331, 332, 341 and 342 are symmetrical in relation to the source center block 31 of the source image 30. From the perspective of resolution symmetry, there is a horizontal axis of symmetry for resolution equality between the source blocks 331 and 332 (equal to 768×64), between the source blocks 321 and 323 (equal to 128×64), and between the source blocks 322 and 324 (equal to 128×64). Moreover, there is also a vertical axis of symmetry for resolution equality between the source blocks 321 and 322 (equal to 128×64), between the source blocks 323 and 324 (equal to 128×64), and between the source blocks 341 and 342 (equal to 128×640). Similarly, the resolutions of the display blocks in the display image 30' have the same symmetrical relations as that of the source blocks as mentioned above.

Referred back to FIG. 6B, the scaling factors corresponding to the source blocks 31, 321, 322, 323, 324, 331, 332, 341 and 342 can be identified and here indicated as 31(x3, x3), 321(x1, x1), 322 (x1, x1), 323(x1, x1), 324(x1, x1), 331(x3, x1), 332(x3, x1), 341(x1, x3) and 342(x1, x3). From the perspective of gradual proportion, the scaling factors corresponding to the source image 30 are arranged in a gradually decreased proportion from the central area of the source image 30 to a peripheral area of the source image 30. For example, the source center block 31 has a pair of scaling factors (x3, x3) in horizontal and vertical directions, and each of the peripheral source blocks 321, 322, 323, 324, 331, 332, 341 and 342 surrounding the source center block 31 has its own pair of scaling factors in (x1, x1), (x3, x1) or (x1, x3) such that the scaling factors of the peripheral source blocks are arranged in a gradually decreased order in relation to that of the source center block 31.

Figure 7A:
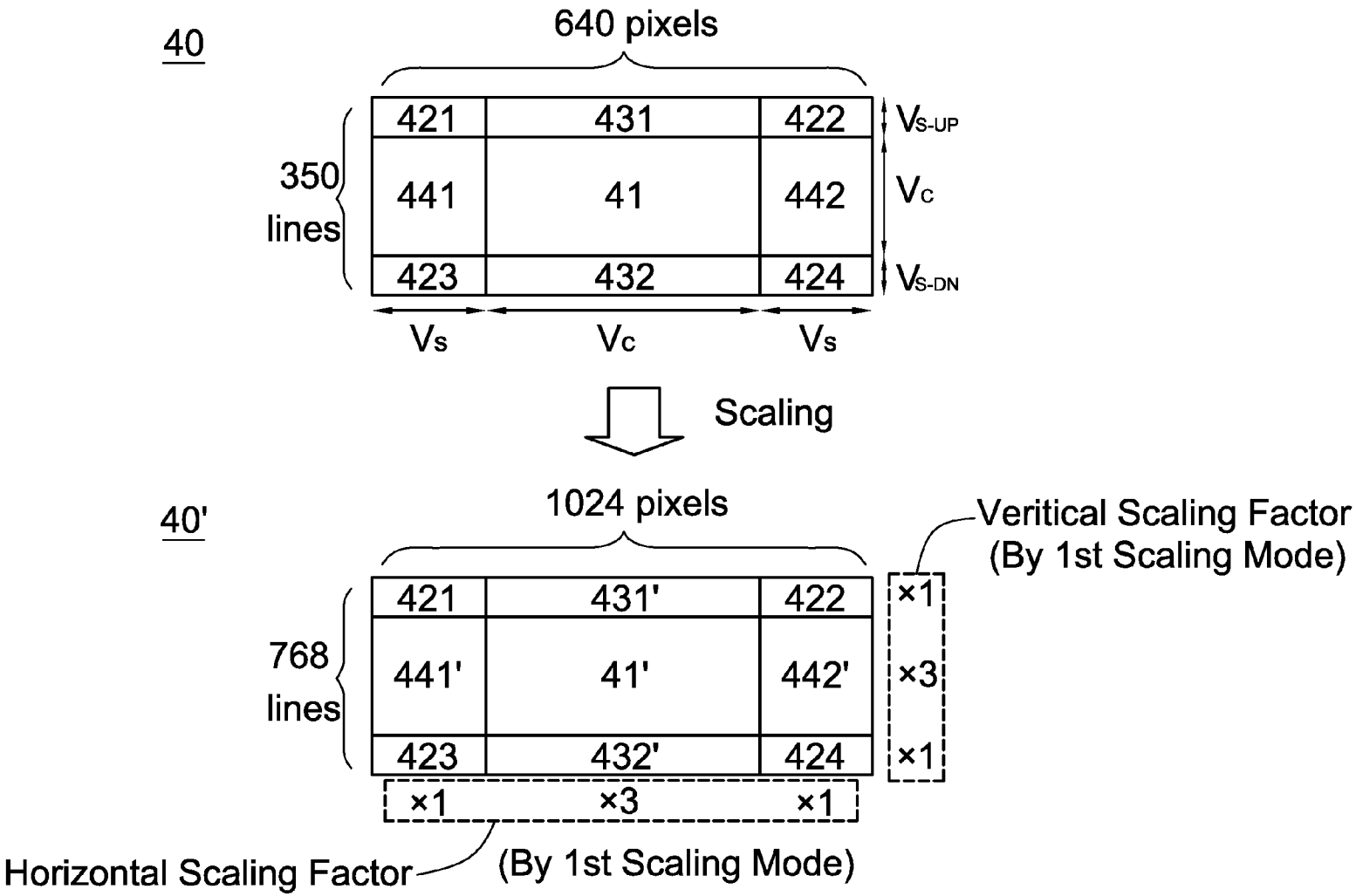
FIG. 7A is diagrammatic sketch showing a first scaling mode operation from a source image with resolution 640×350 converted to a scaled image with display resolution 1024×768 in the embodiment.
Figure 7B:
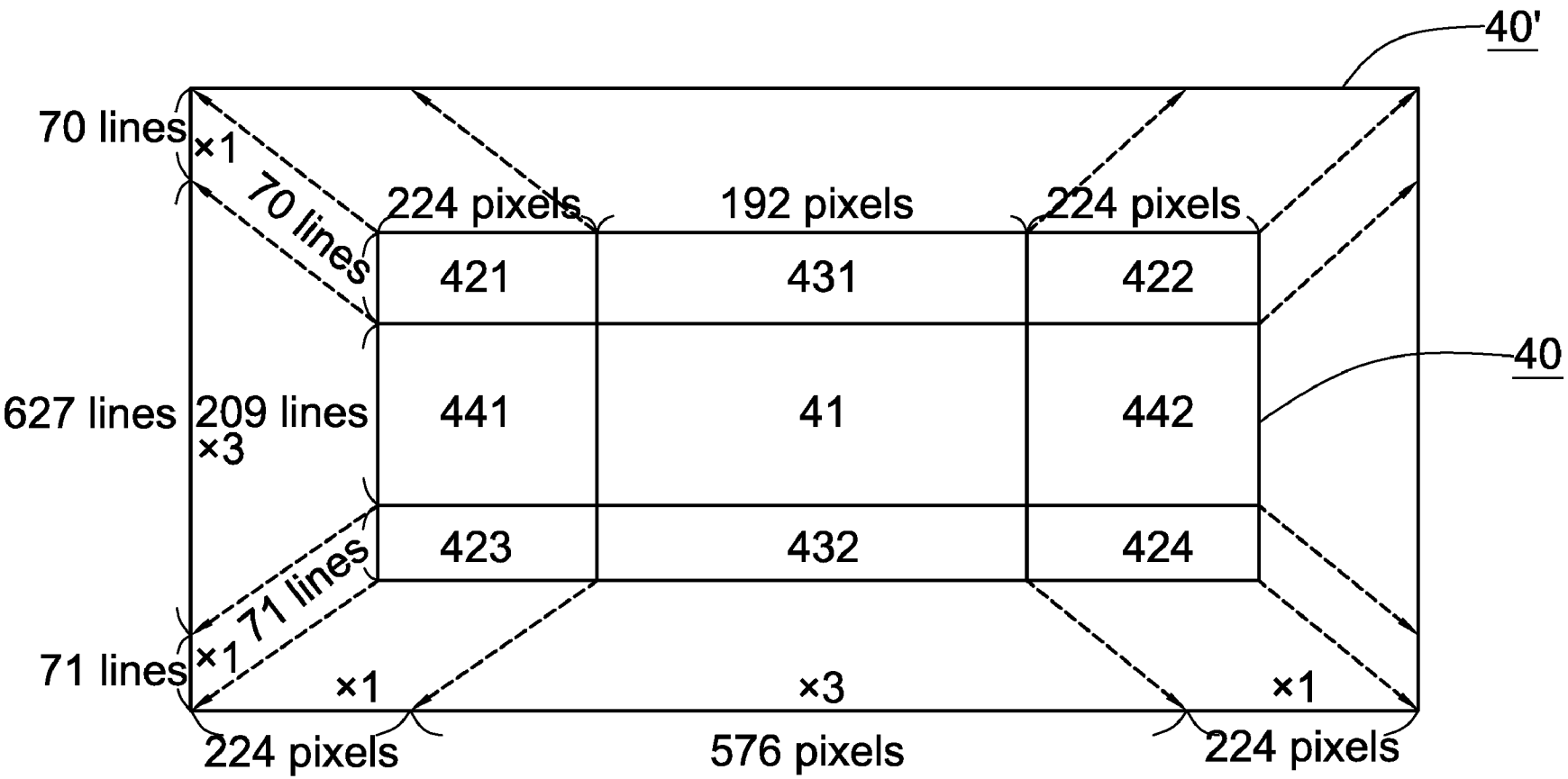
FIG. 7B is a diagrammatic sketch showing a mapping relation from the source resolution 640×350 onto the display resolution 1024×768 in the embodiment.

Referred to FIGS. 7A and 7B, the first scaling mode operation also provided for a source image 40 of resolution Vi (640×350) converted into a display image 40' of resolution Vo (1024×768) and the mapping relation between source image 40 and display image 40' are described herein. When the scaling factor generation module 22 receives resolution Vi of the source image 40 and resolution Vo of the display image 40' defined by the display panel 29 in the scaling phase, the first scaling mode 221 is again triggered according to the predetermined selection rule so as to calculate a value set including a center resolution Vc and a sided resolution Vs during a horizontal and a vertical scaling periods, and the sided resolution Vs, in the case that Vs is not an integer calculated by the equation (2), is determined in the smoothing phase by an up-sided resolution Vs-up and a down-sided resolution Vs-dn determined by equations (3) and (4) as follows:

$$Vs\text{-up}=(3*Vi-Vo)/4-0.5 \quad (3); \text{ and}$$

$$Vs\text{-dn}=(3*Vi-Vo)/4+0.5 \quad (4),$$

Hence, the source image 40 is logically divided into a plurality of source blocks 41, 421, 422, 423, 424, 431, 432, 441 and 442 wherein the source center block 41 has a divided resolution value Vc=192 pixels determined by the equation (1) during the horizontal scaling period and Vc=209 lines determined by the equation (1) during the vertical scaling period, Vc labeled in FIG. 7A and its corresponding values labeled in FIG. 7B. Besides, each of the peripheral source blocks 421, 422, 423, 424, 431, 432, 441 and 442 surrounding the source center block 41 has its respective divided resolution value Vs in pixels determined by the equation (2) during its horizontal scaling period, and Vs has Vs-up and Vs-dn in lines determined by the equations (3) and (4) during its vertical scaling period, Vs-up or Vs-dn labeled in FIG. 7A and its corresponding values labeled in FIG. 7B. For example, both the source blocks 421 and 423 surrounding the source center block 41 have the same resolution values Vs during its horizontal scaling period but both have slightly different resolution values Vs corresponding to Vs-up and Vs-dn during its vertical scaling period, that is, the source blocks 421 has a resolution value Vs=227 pixels during its horizontal scaling period and Vs-up=70 lines as Vs during its vertical scaling period while the source blocks 423 has the same resolution value Vs=227 pixels during its horizontal scaling period and Vs-dn=71 lines as Vs during its vertical scaling period. Therefore, each of the other source blocks 422, 424, 431, 432, 441 and 442 surrounding the source center block 41 has its respective resolution values Vs and (that is Vs-up or Vs-dn) in pixels and lines labeled in FIG. 7B during its horizontal and vertical scaling period. It is noted that both Vs-up and Vs-dn can be determined in the smoothing phase by the above mentioned equations (3) and (4), or equations (4) and (3), and the value of 0.5 in this embodiment provided in the equations (3) and (4) can be replaced with a different value to modify Vs-up and Vs-dn so as to improve image smoothness of the scaled image according to the display application. Besides, the equations (3) and (4) can be one of the smoothing methods and the present invention should not be limited to the particular method.

Referred back to FIGS. 7A and 7B, for example, the source center block 41 of a divided resolution (192 pixels×209 lines) has a pair of scaling factors: x3 and x3 in horizontal and vertical directions respectively so that the source center block 41 (192 pixels×209 lines) can be upscaled to the corresponding display center block 41' (576 pixels×627 lines) by a horizontal scaling factor x3 and a vertical scaling factor x3 where the display center block 41' is indicated as 41'(x3, x3). Similarly, the other source blocks 421, 422, 423, 424, 431, 432, 441 and 442 of the source image 40 are upscaled to the display blocks 421(x1, x1), 422 (x1, x1), 423(x1, x1), 424(x1, x1), 431'(x3, x1), 432'(x3, x1), 441'(x1, x3), and 442' (x1, x3) shown in FIG. 7A, wherein each of the display blocks 431', 432', 441' and 442' numbering ended with ' in the display image 40' means that there is at least a scaling factor greater than one in either horizontal or vertical scaling while each of the blocks 421, 422, 423 and 424 numbering ended without ' in the display image 40' is remained as its same original source image.

Besides, referred back to FIG. 7B, resolutions of the source blocks 421, 422, 423, 424, 431, 432, 441 and 442 are symmetrical in relation to the source center block 41 of the source image 40. From the perspective of resolution symmetry, there is a horizontal axis of symmetry for resolution quasi-equality between the source blocks 431 and 432 (192×70 quasi-equal to 192×71), between the source blocks 421 and 423 (224×70 quasi-equal to 224×71), and between the source blocks 422 and 424 (224×70 quasi-equal to 224×71). Moreover, there is also a vertical axis of symmetry for resolution equality between the source blocks 421 and 422 (equal to 224×70), between the source blocks 423 and 424 (equal to 224×71), and between the source blocks 441 and 442 (equal to 224×209). Similarly, the resolutions of the display blocks in the display image 40' have the same symmetrical relations as that of the source blocks as mentioned above.

Referred back to FIG. 7B, the scaling factors corresponding to the source blocks 421, 422, 423, 424, 431, 432, 441 and 442 are generated in gradual proportion in relation to the source center block 41 of the source image 40. From the perspective of gradual proportion, scaling factors are arranged in a gradually decreased proportion from the central area of the source image 40 to a peripheral area of the source image 40. For example, the source center block 41 has a pair of scaling factors (x3, x3) in horizontal and vertical directions, and each of the peripheral source blocks 421, 422, 423, 424, 431, 432, 441 and 442 surrounding the source center block 41 has its own pair of scaling factors in (x1, x1) or (x3, x1) or (x1, x3) arranged in a gradually decreased order from the pair of scaling factors (x3, x3) of the source center block 41.

Figure 8A:
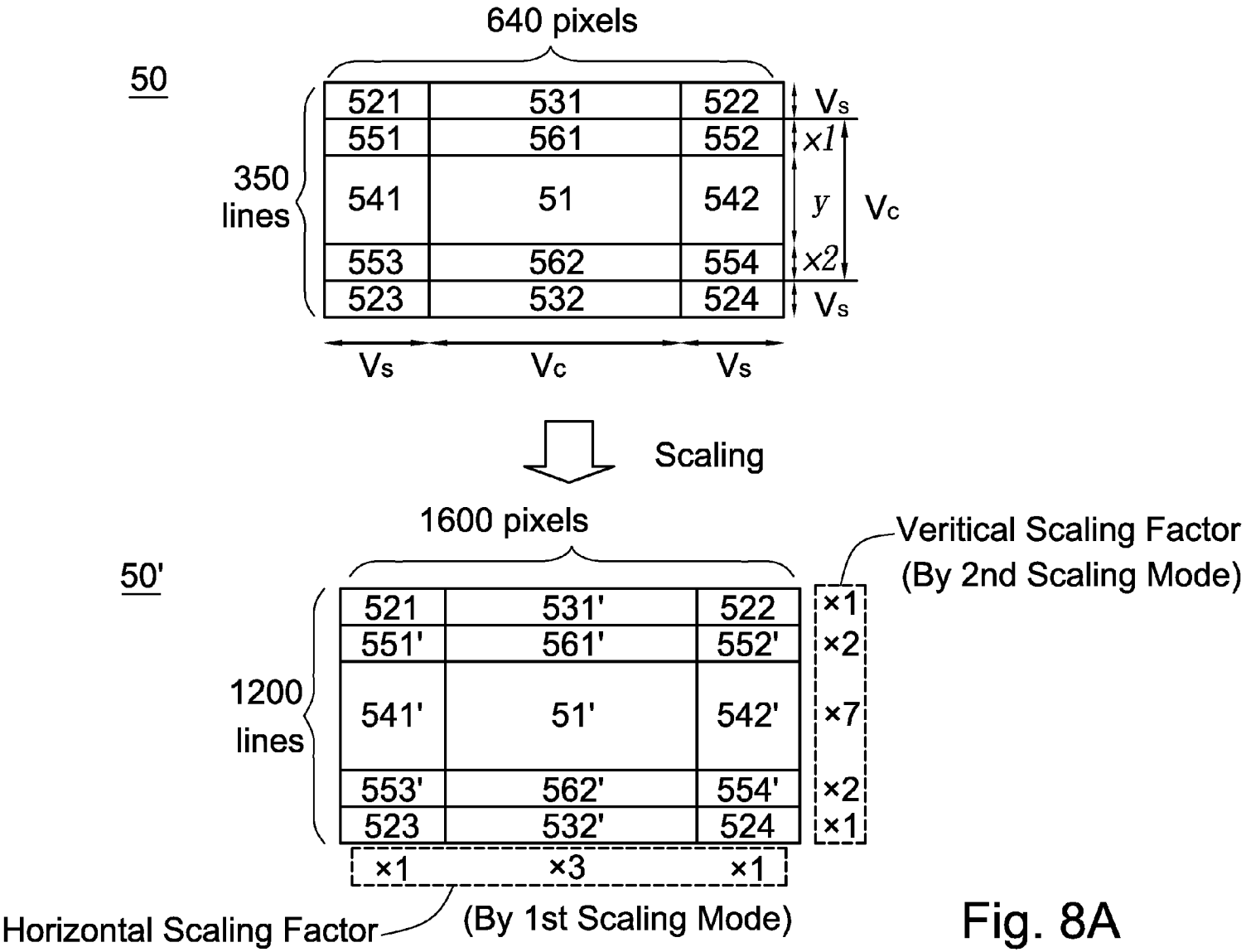
FIG. 8A is diagrammatic sketch showing a first scaling mode operation during a horizontal scaling period and a second scaling mode operation during a vertical scaling period from a source image with resolution 640×350 converted to a scaled image with display resolution 1600×1200 in the embodiment.
Figure 8B:
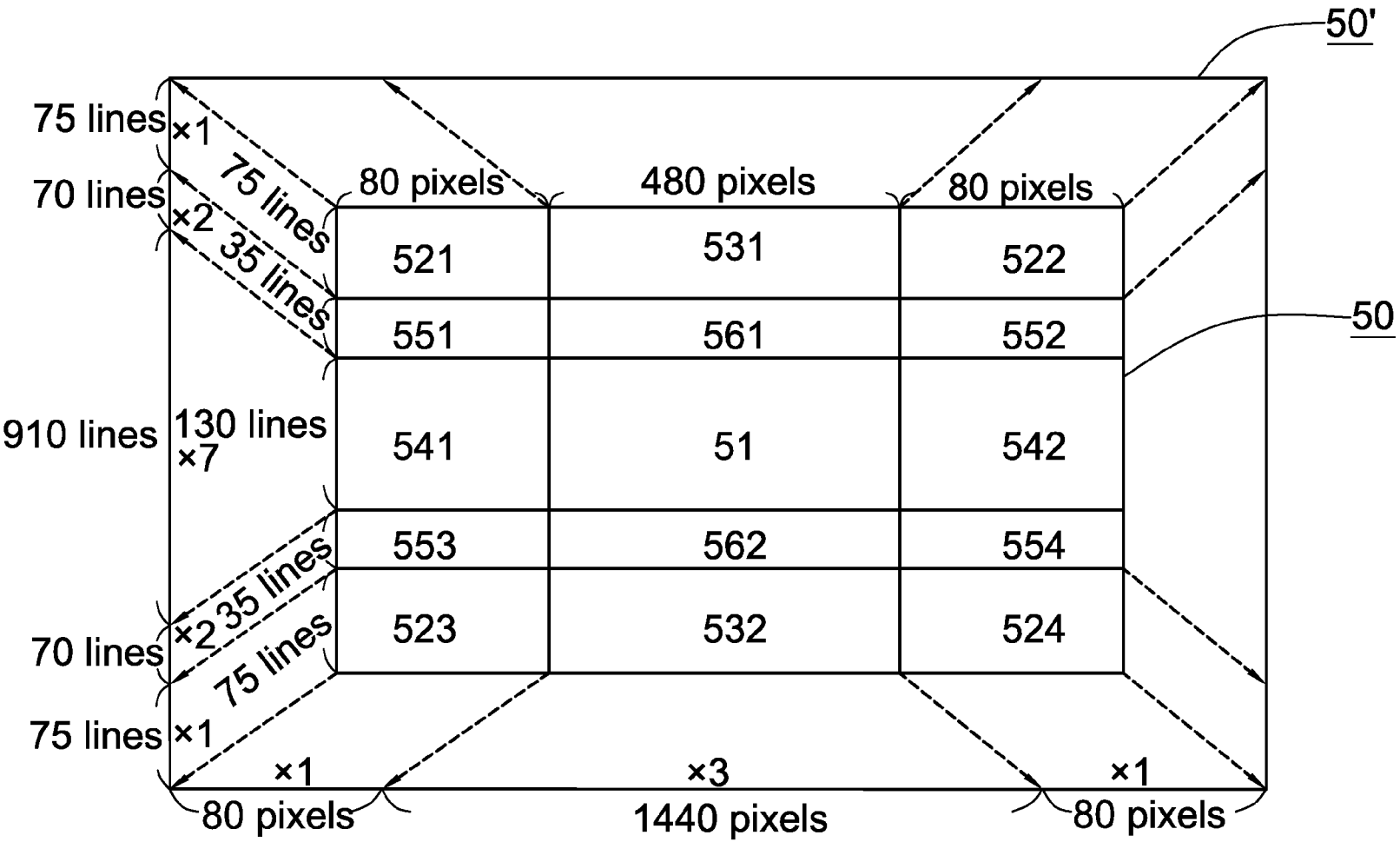
FIG. 8B is a diagrammatic sketch showing a mapping relation from the source resolution 640×350 onto the display resolution 1600×1200 in the embodiment.

Referred to FIGS. 8A and 8B, operations of the first and second scaling modes are provided for a source image 50 of resolution Vi (640×350) converted into a display image 50' of resolution Vo (1600×1200) and the mapping relation between source image 50 and display image 50' are described herein. In this case, when the scaling factor generation module 22 receives resolution Vi of the source image 50 and resolution Vo of the display image 50' defined by the display panel 29 in the scaling phase, the first scaling mode 221 and the second scaling mode 222 are triggered in the horizontal and vertical scaling periods, respectively, according to the predetermined selection rule so as to calculate one value set including a sided resolution Vs and a center resolution Vc determined by equations (1) and (2) during the horizontal scaling period, and another value set including a sided resolution Vs and a center resolution Vc determined by equations (5), (6) and (7) during the vertical scaling period as follows:

$$Vs=(Vo-3*Vi)/2 \quad (5);$$

$$Vc=Vi-2*Vs=x+y, \quad (6); \text{ and}$$

$$2*x+z*y=Vo-2*Vs \quad (7),$$

where x>0, y>0, z>2, x=x1+x2, and x, y, z, x1, x2 are positive integers, respectively, and x1, x2, y, Vs and Vc (combined by x1, y and x2) labeled in FIG. 8A.

In this case, the source image 50 is logically divided into five sections of source blocks for each of sections including three source column blocks. All the source blocks are indicated by 521, 531 and 522 for the $1^{st}$ section, 551, 561 and 552 for the $2^{nd}$ section, 541, 51 and 542 for the $3^{rd}$ section, 553, 562 and 554 for the $4^{th}$ section, and 523, 532 and 524 for the $5^{th}$ section, accordingly. Each of source blocks has its resolution value in pixels determined from the equations (1) and (2) during the horizontal scaling period, and its resolution value in lines determined from the equations (5), (6) and (7) during the vertical scaling period. For example, during the horizontal scaling period, each of the source blocks 51, 531, 532, 561 and 562 has its corresponding resolution value Vc=480 pixels, Vc labeled in FIG. 8A and its corresponding values labeled in FIG. 8B, determined by the equation (1); each of the source blocks 521, 522, 523, 524, 541, 542, 551, 552, 553 and 554 has its corresponding resolution value Vs=80 pixels, Vs labeled in FIG. 8A and its corresponding values labeled in FIG. 8B, determined by the equation (2). During the vertical scaling period, each of the source blocks 521, 522, 523, 524, 531 and 532 has its corresponding resolution value Vs=75 lines, Vs labeled in FIG. 8A and its corresponding values labeled in FIG. 8B, determined by the equation (5); each of the source blocks 551, 552 and 561 has its corresponding resolution value x1=35 lines, x1 labeled in FIG. 8A and its corresponding values labeled in FIG. 8B, determined by the equations (6) and (7); each of the source blocks 553, 554 and 562 has its corresponding resolution value x2=35 lines, x2 labeled in FIG. 8A and its corresponding values labeled in FIG. 8B, determined by the equations (6) and (7); each of the source blocks 51, 541 and 542 has its corresponding resolution value y=130 lines, y labeled in FIG. 8A and its corresponding values labeled in FIG. 8B, determined by the equations (6) and (7). Usually, both x1 and x2 in lines are set to be equal between the source blocks 551 and 553, between 552 and 554, between 561 and 562 in relation to the source center block 51 so as to further maintain better visional effect of display.

Besides, referred back to FIG. 8A, each of the source blocks has its pair of corresponding scaling factors in horizontal and vertical directions respectively so that all the source blocks can be upscaled to the corresponding display blocks by multiplying the resolution value of each source block by the scaling factor thereof. Therefore, each display block having its pair of corresponding scaling factors (horizontal, vertical) is indicated as 51'(x3, x7), 521(x1, x1), 522(x1, x1), 523(x1, x1), 524(x1, x1), 531'(x3, x1), 532'(x3, x1), 541'(x1, x7), 542'(x1, x7), 551'(x1, x2), 552'(x1, x2), 553'(x1, x2), 554'(x1, x2), 561'(x3, x2) and 562'(x3, x2), wherein each of the display blocks 51', 531', 532', 541', 542', 551', 552', 553', 554', 561' and 562' numbering ended with ' in the display image 50' means that there is at least a scaling factor greater than one in either horizontal or vertical scaling while each of the display blocks 521,522, 523 and 524 numbering ended without ' in the display image 50' is remained as its same original source image.

Referred back to FIG. 8B, from the perspective of the resolution symmetry in relation to the source center block 51, there is a horizontal axis of symmetry for resolution equality between the source blocks 531 and 532 (equal to 480×75), between the source blocks 521 and 523 (equal to 80×75), between the source blocks 522 and 524 (equal to 80×75), between the source blocks 551 and 553 (equal to 80×35), between the source blocks 552 and 554 (equal to 80×35), and between the source blocks 561 and 562 (equal to 480×35) in relation to the source center block 51 along a horizontal direction. Moreover, there is also a vertical axis of symmetry for resolution equality between the source blocks 521 and 522 (equal to 80×75), between the source blocks 523 and 524 (equal to 80×75), between the source blocks 541 and 542 (equal to 80×130), between the source blocks 551 and 552 (equal to 80×35), and between the source blocks 553 and 554 (equal to 80×35) in relation to the source center block 51 along a vertical direction. Similarly, the resolutions of the display blocks in the display image 50' have the same symmetrical relations as that of the source blocks as mentioned above.

Referred back to FIG. 8B, the scaling factors corresponding to the source blocks except the source center block 51 are generated in gradual proportion in relation to the source center block 51 of the source image 50. From the perspective of gradual proportion, the scaling factors are arranged in a gradually decreased proportion from the central area of the source image 50 to a peripheral area of the source image 50. For example, the source center block 51 has a pair of scaling factors indicated as 51(x3, x7), and the first peripheral source blocks 541, 542, 561 and 562 surrounding the source center block 51 have pairs of scaling factors as 541(x1, x7), 542(x1, x7), 561(x3, x2), and 562(x3, x2) circumferentially arranged in a gradually decreased order from the pair of scaling factors (x3, x7) of the source center block 51. The second peripheral source blocks 531, 532, 551, 552, 553 and 554 surrounding the first peripheral source blocks have pairs of scaling factors as 531(x3, x1), 532(x3, x1), 551(x1, x2), 552(x1, x2), 553(x1, x2) and 554(x1, x2) circumferentially arranged in a gradually decreased order from the pairs of scaling factors of first peripheral source blocks. The third peripheral source blocks 521, 522, 523 and 524 surrounding the second peripheral source blocks have pairs of scaling factors as 521(x1, x1), 522(x1, x1), 523(x1, x1) and 524(x1, x1) circumferentially arranged in a gradually decreased order from the pairs of scaling factors of second peripheral source blocks.

Figure 9A:
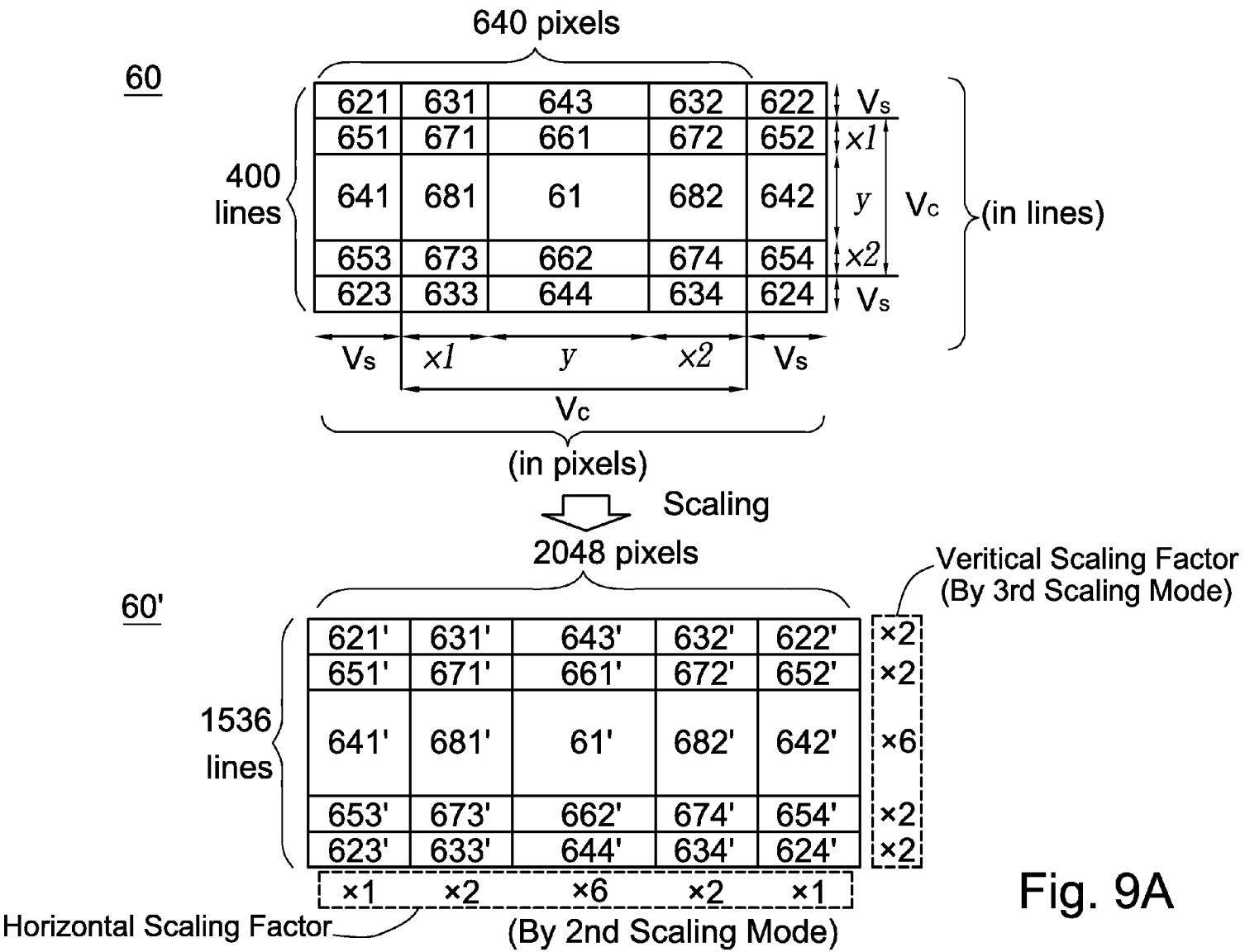
FIG. 9A is diagrammatic sketch showing a second scaling mode operation during a horizontal scaling period and a third scaling mode operation during a vertical scaling period from a source image with resolution 640×400 converted to a scaled image with display resolution 2048×1536 in the embodiment.
Figure 9B:
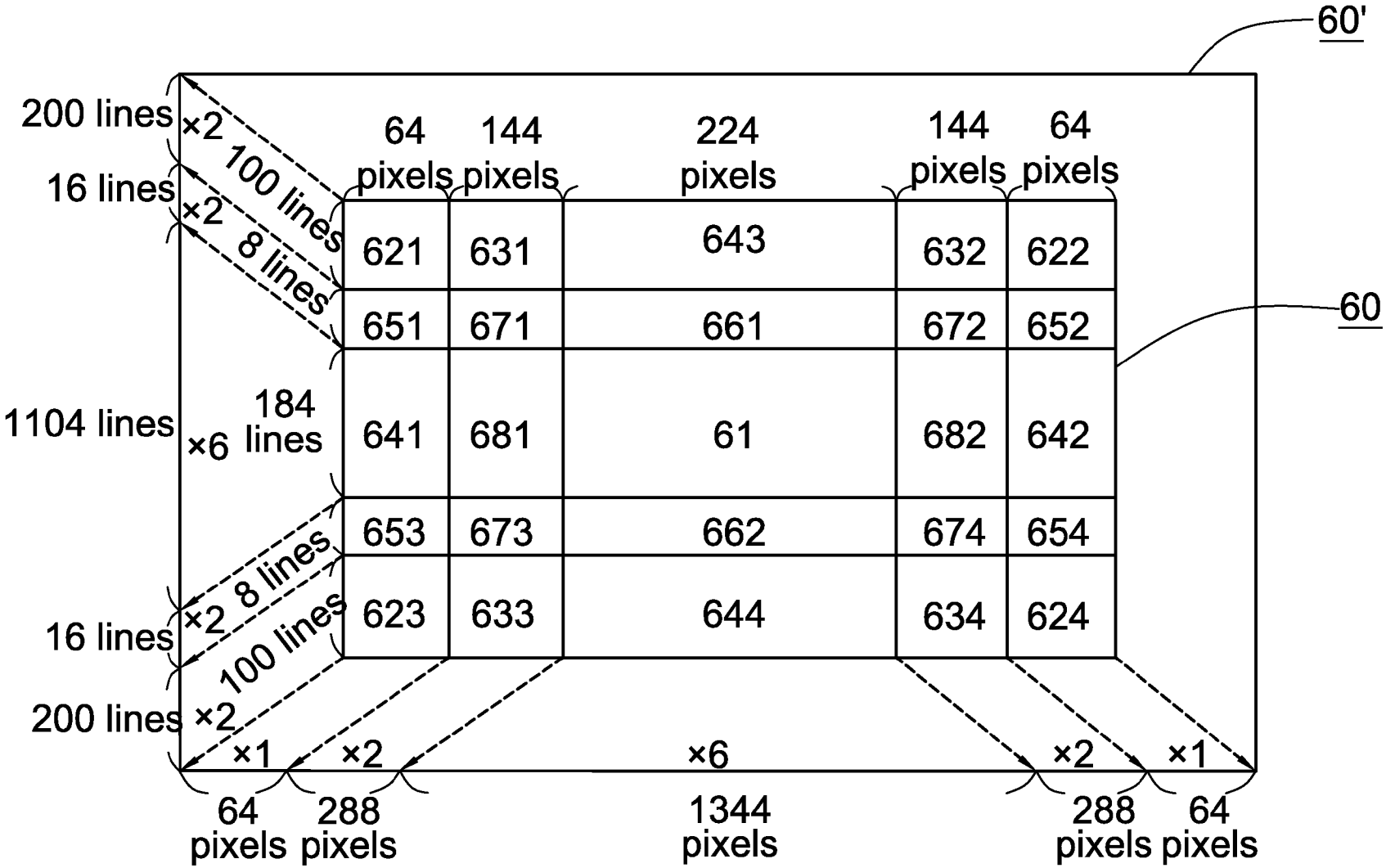
FIG. 9B is a diagrammatic sketch showing a mapping relation from source resolution 640×400 onto display resolution 2048×1536 in the embodiment.

Referred to FIGS. 9A and 9B, operations of the second and third scaling modes are provided for a source image 60 of resolution Vi (640×400) converted into a display image 60' of resolution Vo (2048×1536) and the mapping relation between source image 60 and display image 60' are described herein. When the scaling factor generation module 22 receives resolution Vi of the source image 60 and resolution Vo of the display image 60' defined by the display panel 29 in the scaling phase, the second scaling mode 222 and the third scaling mode 223 are triggered in the horizontal and vertical scaling periods, respectively, according to the predetermined selection rule, so as to calculate one value set including a sided resolution Vs and a center resolution Vc determined by equations (5)-(7) during the horizontal scaling period, and another value set including a sided resolution Vs and a center resolution Vc in the scaling phase during the vertical scaling period wherein Vs is determined by equation (8) if Vi is an integer multiple of four, otherwise Vs is selected from Vs-up and Vs-dn determined by equation (9) or (10) in the smoothing phase, and wherein Vc is divided into x and y determined by equations (11) and (12) as follows:

$$Vs=Vi/4, \text{ if } Vs=\text{integer} \quad (8);$$

$$Vs\text{-up}=Vi/4-0.5, \text{ otherwise} \quad (9);$$

$$Vs\text{-dn}=Vi/4+0.5, \text{ otherwise} \quad (10);$$

$$Vc=Vi-2*Vs=x+y \quad (11); \text{ and}$$

$$2*x+z*y=Vo-Vi \quad (12),$$

where x>0, y>0, z>2, x=x1+x2, and x, y, z, x1, x2 are positive integers, respectively, and x1, x2, y, Vs and Vc (divided into x1, y and x2) labeled in FIG. 9A. It is noted that both Vs-up and Vs-dn can be determined by the above mentioned equations (9) and (10), or equations (10) and (9) in the smoothing phase, and the value of 0.5 in this embodiment provided in the equations (9) and (10) can be replaced with a different value to modify Vs-up and Vs-dn so as to improve image smoothness of the scaled image according to the display application. Besides, the equations (9) and (10) can be one of the smoothing methods and the present invention should not be limited to the particular method.

In this case, the source image 60 is logically divided into five sections of source blocks for each of sections including five source column blocks. All the source blocks are indicated by 621, 631, 643, 632 and 622 for the 1$^{st}$ section, 651, 671, 661, 672 and 652 for the 2$^{nd}$ section, 641, 681, 61, 682 and 642 for the 3$^{rd}$ section, 653, 673, 662, 674 and 654 for the 4$^{th}$ section, and 623, 633, 644, 634 and 624 for the 5$^{th}$ section, accordingly. Each of the source blocks has its resolution value in pixels determined from the equations (5), (6) and (7) during the horizontal scaling period, and its resolution value in lines determined from the equations (8), (9), (10), (11) and (12) during the vertical scaling period. For example, during the horizontal scaling period, each of the source blocks 621, 622, 623, 624, 641, 642 651, 652, 653 and 654 has its corresponding resolution value Vs=64 pixels determined by the equation (5), Vs labeled in FIG. 9A and its corresponding values labeled in FIG. 9B; each of the source blocks 631, 671, 681, 673 and 633 has its corresponding resolution value x1=144 pixels determined by the equations (6) and (7), labeled in FIG. 9A and its corresponding values labeled in FIG. 9B; each of the source blocks 632, 672, 682, 674 and 634 has its corresponding resolution value x2=144 pixels determined by the equations (6) and (7), labeled in FIG. 9A and its corresponding values labeled in FIG. 9B; each of the source blocks 643, 661, 61, 662 and 644 has its corresponding resolution value y=224 pixels determined by the equations (6) and (7), labeled in FIG. 9A and its corresponding values labeled in FIG. 9B. Usually, both x1 and x2 in pixels are set to be equal between the source blocks 631 and 632, between 633 and 634, between 671 and 672, between 673 and 674, and between 681 and 682 in relation to the source center block 61 so as to further maintain better visional effect of display. During the vertical scaling period, each of the source blocks 621, 622, 623, 624, 631, 632 633, 634, 643 and 644 has its corresponding resolution value Vs=100 lines determined by the equation (8), Vs labeled in FIG. 9A and its corresponding values labeled in FIG. 9B; each of the source blocks 651, 671, 661, 672 and 652 has its corresponding resolution value x1=8 lines determined by the equations (11) and (12), labeled in FIG. 9A and its corresponding values labeled in FIG. 9B; each of the source blocks 653, 673, 662, 674 and 654 has its corresponding resolution value x2=8 lines determined by the equations (11) and (12) labeled in FIG. 9A and its corresponding values labeled in FIG. 9B; each of the source blocks 641, 681, 61, 682 and 642 has its corresponding resolution value y=184 lines determined by the equations (11) and (12), labeled in FIG. 9A and its corresponding values labeled in FIG. 9B. Usually, both x1 and x2 in lines are set to be equal between the source blocks 651 and 653, between 652 and 654, between 661 and 662, between 671 and 673, between 672 and 674 in relation to the source center block 61, so as to further maintain better visional effect of display.

Besides, referred back to FIG. 9A, each of the source blocks has its pair of corresponding scaling factors in horizontal and vertical directions respectively so that all the source blocks can be upscaled to the corresponding display blocks by multiplying the resolution value of each source block by the scaling factor thereof. Therefore, each display block having its pair of corresponding scaling factors (horizontal, vertical) is indicated as 61'(x6, x6), 621'(x1, x2), 622'(x1, x2), 623'(x1, x2), 624'(x1, x2), 631'(x2, x2), 632'(x2, x2), 633'(x2, x2), 634'(x2, x2), 641'(x1, x6), 642'(x1, x6), 651'(x1, x2), 652'(x1, x2), 653'(x1, x2), 654'(x1, x2), 661'(x6, x2), 662'(x6, x2), 671'(x2, x2), 672'(x2, x2), 673'(x2, x2), 674'(x2, x2), 681'(x2, x6) and 682'(x2, x6), wherein all of the display blocks numbering ended with ' in the display image 60' means that there is at least a scaling factor greater than one in either horizontal or vertical scaling.

Referred back to FIG. 9B, from the perspective of the resolution symmetry in relation to the source center block 61, there is a horizontal axis of symmetry for resolution equality in relation to the source center block 61 along a horizontal direction between the source blocks 631 and 633 (equal to 144×100), between the source blocks 632 and 634 (equal to 144×100); between the source blocks 621 and 623 (equal to 64×100), between the source blocks 622 and 624 (equal to 64×100); between the source blocks 651 and 653 (equal to 64×8), between the source blocks 652 and 654 (equal to 64×8); between the source blocks 661 and 662 (equal to 224×8); between the source blocks 671 and 673 (equal to 144×8), between the source blocks 672 and 674 (equal to 144×8).

Moreover, there is also a vertical axis of symmetry for resolution equality in relation to the source center block 61 along a vertical direction between the source blocks 621 and 622 (equal to 64×100), between the source blocks 623 and 624 (equal to 64×100); between the source blocks 631 and 632 (equal to 144×100), between the source blocks 633 and 634 (equal to 144×100); between the source blocks 651 and 652 (equal to 64×8), and between the source blocks 653 and 654 (equal to 64×8); between the source blocks 641 and 642 (equal to 64×184); between the source blocks 681 and 682 (equal to 144×184); between the source blocks 671 and 672 (equal to 144×8), and between the source blocks 673 and 674 (equal to 144×184). Similarly, the resolutions of the display blocks in the display image 60' have the same symmetrical relations as that of the source blocks as mentioned above.

Referred back to FIG. 9B, the scaling factors corresponding to the source blocks except the source center block 61 are generated in gradual proportion in relation to the source center block 61 of the source image 60. From the perspective of gradual proportion, the scaling factors corresponding to the source image 60 are arranged in a gradually decreased proportion from the central area of the source image 60 to a peripheral area of the source image 60. For example, the source center block 61 has a pair of scaling factors indicated as 61(x6, x6), and the first peripheral source blocks 671, 661, 672, 682, 674, 662, 673 and 681 surrounding the source center block 61 have pairs of scaling factors such as 671(x2, x2), 661(x6, x2), 672(x2, x2), 682(x2, x6), 674(x2, x2), 662 (x6, x2), 673(x2, x2) and 681(x2, x6) arranged in a gradually decreased order from the pair of scaling factors (x6, x6) of the source center block 61. The second peripheral source blocks 621, 631, 643, 632, 622, 652, 642, 654, 624, 634, 644, 633, 623, 653, 641 and 651 surrounding the first peripheral source blocks have pairs of scaling factors such as 621(x1, x2), 631(x2, x2), 643(x6, x2), 632(x2, x2), 622(x1, x2), 652(x1, x2), 642(x1, x6), 654(x1, x2), 624(x1, x2), 634(x2, x2), 644 (x6, x2), 633(x2, x2), 623(x1, x2), 653(x1, x2), 641(x1, x6) and 651(x1, x2) arranged in a gradually decreased order from the pairs of scaling factors of first peripheral source blocks. The third peripheral source blocks 621, 622, 624 and 623 surrounding the second peripheral source blocks have pairs of scaling factors as 621(x1, x2), 622(x1, x2), 624(x1, x2) and 623(x1, x2) arranged in a gradually decreased order from the pairs of scaling factors of second peripheral source blocks.

Referred back to FIG. 2, the display system 20 further comprises an input timing module 28 that judges the input timing-formats based on the VESA standard of the source image and then sends signals, indicated as dot-line, to the input buffer 21, the scaling factor generation module 22, the horizontal scaling execution module 24, the memory control module 23, the vertical scaling execution module 25 and the output buffer 26 for signal synchronization. Besides, the display system 20 further comprises an output re-timing module 27 that sends signals, indicated as dot-line, to the input buffer 21, the input timing module 28, the horizontal scaling execution module 24, the memory control module 23, the vertical scaling execution module 25 and the output buffer 26 for adjusting horizontal and vertical frequencies varying from the original resolution of the source image to the display resolution of the display panel. Besides, the output re-timing module 27 further regenerates signals, indicated as dot-line, regarding various frequency for clocks (i.e. CLKs), vertical signal synchronization VS, horizontal signal synchronization HS and data enable DE to the memory control module 23, the vertical scaling execution module 25 and the output buffer 26.

Figure 10:
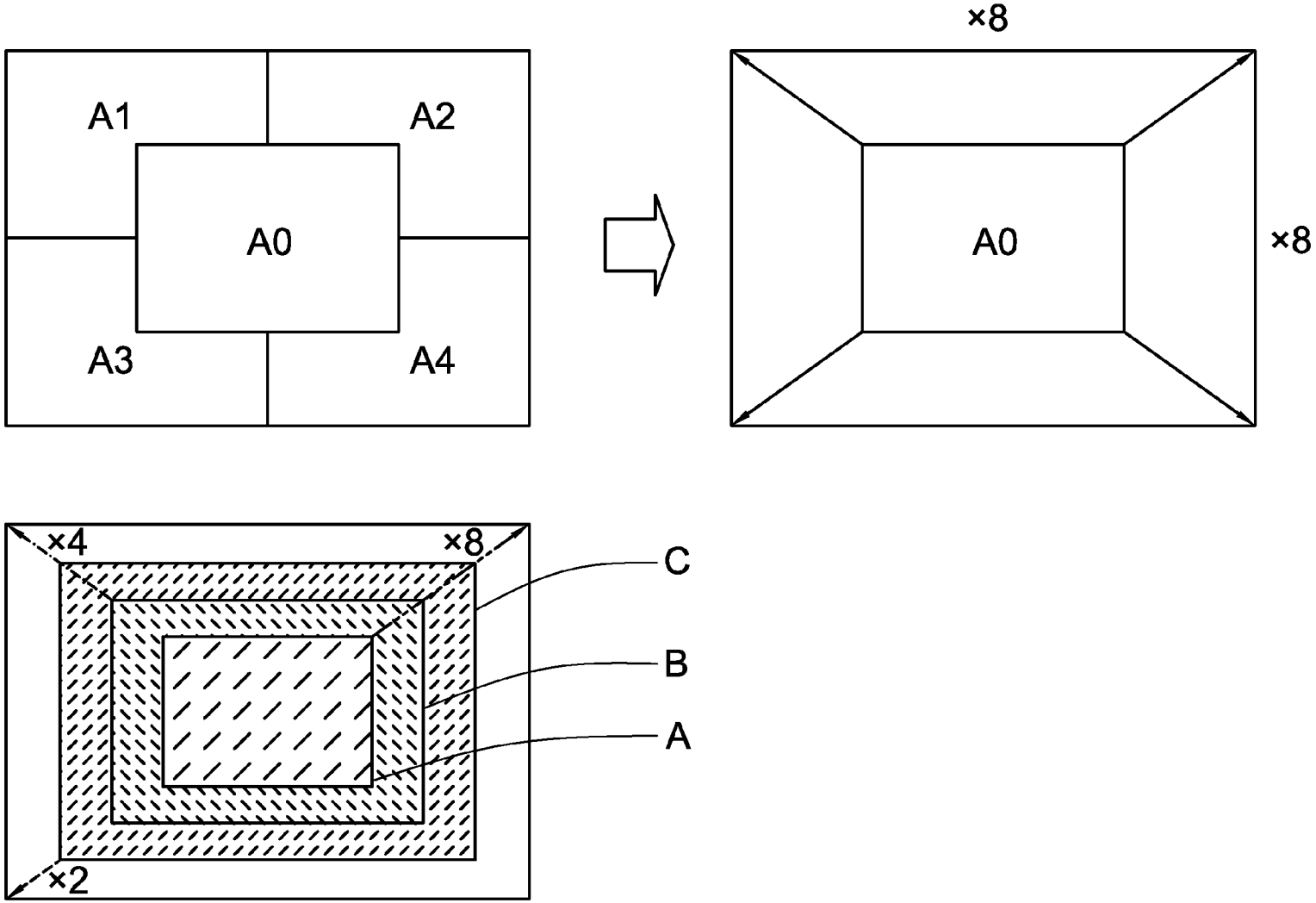
FIG. 10 is a diagrammatic sketch showing a magnification of an integer multiple of two in the embodiment.

Besides, referred to FIG. 10, a source image converted to a display image by magnification of an integer multiple of two is described herein. A source image is divided into five parts of source blocks A0, A1, A2, A3 and A4. For example, when the block A0 is magnified (i.e. partially scaled) by 8 times for display resolution, the magnifier mode 224 of the scaling factor generation module 22 will be triggered to execute horizontal and vertical magnification of the block A0 by 8 times for display so that A0 can be enlarged for viewing in the case of medical surgery or medical operation. A1, A2, A3, and A4 can be selected to magnify by 8 times. Similarly, the magnification factor can be 2 times, 4 times, . . . and so on.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A display system comprising:

an input buffer to receive a set of pixel data from a source image in a line direction, in a first-in-first-out and pixel-by-pixel fashion;

a scaling factor generation module to generate a scaling value set according to an original resolution Vi of said source image and a display resolution Vo of a display panel, respectively;

a horizontal scaling execution module to receive said scaling value set from said scaling factor generation module so as to determine pixel replication of each pixel from said set of pixel data in said input buffer for outputting each scaled line formed of replicated pixels by said pixel replication;

a memory control module to receive replicated pixels of said scaled line from said horizontal scaling execution module and subsequently storing at least a complete image file formed of said scaled lines based on addressing management;

a vertical scaling execution module to receive said scaling value set from said scaling factor generation module so as to determine line replication of each scaled line in said memory control module for outputting; and an output buffer to receive replicated scaled lines by means of said line replication of said vertical scaling execution module, and to output each of said scaled lines to said display panel in a first-in-first-out and pixel-by-pixel fashion.

2. A display system according to claim 1, wherein said scaling factor generation module further comprises a first scaling mode, a second scaling mode and a third scaling mode.

3. A display system according to claim 2, wherein said scaling factor generation module further comprises a magnifier mode to scale said source image up to an integer multiple of two.

4. A display system according to claim 2, wherein said scaling value set, determined by said first scaling mode, includes a center resolution Vc, a sided resolution Vs, and scaling factors equal to 1 and 3 corresponding to Vs and Vc.

5. A display system according to claim 4, wherein said center resolution Vc is determined by the equation:

$$Vc=(Vo-Vi)/2, \text{ and}$$

said sided resolution Vs is determined by the equation:

$$Vs=(3*Vi-Vo)/4,$$

when Vc and Vs are integer multiples, respectively.

6. A display system according to claim 5, wherein said sided resolution value Vs is combined by an upper sided resolution value Vs-up and a lower sided resolution value Vs-dn, when Vs is not an integer multiple, and wherein Vs-up is determined by the equation:

$$Vs\text{-up}=(3*Vi-Vo)/4-0.5 \text{ and}$$

Vs-dn is determined by the equation:

$$Vs\text{-dn}=(3*Vi-Vo)/4+0.5.$$

7. A display system according to claim 2, wherein said scaling value set, determined by said second scaling mode, includes a center resolution Vc, a sided resolution Vs and scaling factors equal to 1, 2, 3 or an integer greater than 3.

8. A display system according to claim 7, wherein said sided resolution value Vs is determined by the equation:

$$Vs=(Vo-3*Vi)/2,$$

said center resolution Vc is determined by the two equations:

$$Vc=Vi-2*Vs=x+y, \text{ and}$$

$$2*x+z*y=Vo-2*Vs$$

where x, y>0 and z=3,4,5, . . . , respectively.

9. A display system according to claim 2, wherein said scaling value set, determined by said third scaling mode, includes a center resolution Vc, a sided resolution Vs and scaling factors equal to 2, 3 or an integer greater than 3.

10. A display system according to claim 9, wherein said side resolution Vs is determined by the equation:

$$Vs=Vi/4,$$

where Vs is an integer multiple, and said center resolution Vc is determined by the two equations:

$$Vc=Vi-2*Vs=x+y, \text{ and}$$

$$2*x+z*y=Vo-Vi$$

where x, y>0 and z=3, 4, 5, . . . , respectively.

11. A display system according to claim 10, wherein said sided resolution Vs is combined by an upper sided resolution Vs-up and a lower sided resolution value Vs-dn, when Vs is not an integer multiple, and wherein Vs-up is determined by the equation:

$$Vs\text{-up}=Vi/4-0.5 \text{ and}$$

$Vs_{__DN}$ is determined by the equation:

$$Vs\text{-dn}=Vi/4+0.5.$$

12. A display system according to claim 1, further comprising an input timing module to judge input timing-formats and then send signals to said input buffer, said scaling factor generation module, said horizontal scaling execution module, said memory control module, said vertical scaling execution module and said output buffer for synchronization.

13. A display system according to claim 1, further comprising an output re-timing module to send signals to said input buffer, said input timing module, said horizontal scaling execution module, said memory control module, said vertical scaling execution module and said output buffer for adjusting horizontal and vertical frequencies varying from said original resolution to said display resolution.

14. A display system according to claim 13, wherein said output re-timing module further regenerates signals regarding various frequency for CLKs, vertical signal synchronization VS, horizontal signal synchronization HS and data enable DE to said memory control module, said vertical scaling execution module and said output buffer.

15. A display system according to claim 1, wherein said input buffer has a variable storage length to receive said set of pixel data in proper timing.

16. A display system according to claim 1, wherein said output buffer has a fixed storage length, determined by said display resolution, for receiving each of said scaled lines in proper timing.

17. A display system according to claim 1, wherein the number of said replicated pixels of each pixel from said input buffer to write into said memory control module is determined by said horizontal scaling execution module.

18. A display system according to claim 1, wherein the number of replicated lines for each scaled line from said memory control module to write into said output buffer is determined by said vertical scaling execution module.

19. A display system according to claim 1, wherein said input buffer is capable of reading and writing said pixel data in a concurrent fashion, and wherein said output buffer is capable of reading and writing said pixel data in a concurrent fashion.

20. A display system according to claim 1, wherein said replicated pixels and said replicated lines are respectively arranged in positional symmetry along said horizontal and vertical directions of said source image, and having gradually scaling proportion from its central region to peripheral regions surrounding said central region of said source image.

* * * * *